United States Patent [19]

Koepke

[11] 4,084,699

[45] Apr. 18, 1978

[54] FILE UNIT

[75] Inventor: Earl H. Koepke, Youngstown, Ohio

[73] Assignee: GF Business Equipment, Inc., Youngstown, Ohio

[21] Appl. No.: 762,058

[22] Filed: Jan. 24, 1977

[51] Int. Cl.[2] ..... B65D 57/00; B42F 17/12

[52] U.S. Cl. ..... 211/11; 211/51; 211/88; 211/133; 211/184; 220/22.3; 220/22.4

[58] Field of Search ..... 211/10, 11, 42, 50, 211/51, 88, 90, 133, 184; 220/22.1, 22.2, 22.3, 22.4, 22.5, 22.6; 312/183, 193; 248/242

[56] References Cited

U.S. PATENT DOCUMENTS

| | | | |
|---|---|---|---|
| 933,643 | 9/1909 | Gnekow | 211/88 |
| 1,752,300 | 4/1930 | Hutchings | 211/184 X |
| 1,756,866 | 4/1930 | Hutchings | 220/22.3 |
| 1,797,884 | 3/1931 | Talabac | 211/133 |
| 1,836,234 | 12/1931 | Furlong | 211/51 |
| 1,838,681 | 12/1931 | Hutchings | 211/50 |
| 2,271,734 | 2/1942 | Dunham | 211/42 |
| 2,272,537 | 2/1942 | West | 211/50 X |
| 2,758,602 | 8/1956 | Anderson | 220/22.3 |
| 2,776,757 | 1/1957 | Schoenlaub | 211/86 |
| 3,221,890 | 12/1965 | Wassell | 211/10 |
| 3,358,692 | 12/1967 | Proulx | 220/22.3 |
| 3,375,830 | 4/1968 | Dixon et al. | 220/22.3 |
| 3,554,381 | 1/1971 | Guest et al. | 211/11 |
| 3,572,626 | 3/1971 | Bertschi | 248/242 |

FOREIGN PATENT DOCUMENTS

| | | | |
|---|---|---|---|
| 716,356 | 8/1965 | Canada | 312/184 |
| 1,241,412 | 1/1967 | Germany | 220/22.3 |
| 2,026,359 | 12/1971 | Germany | 312/184 |
| 217,105 | 6/1924 | United Kingdom | 211/184 |
| 513,063 | 10/1939 | United Kingdom | 211/50 |
| 1,039,557 | 8/1966 | United Kingdom | 312/184 |

*Primary Examiner*—Roy D. Frazier
*Assistant Examiner*—Thomas J. Holko
*Attorney, Agent, or Firm*—Emory L. Groff, Jr.

[57] ABSTRACT

A file device includes a shelf member containing a plurality of dividers each removably attached to the shelf member in a selective longitudinal position by means allowing of pivotal displacement about its lower edge. A compressible pad upon the shelf floor constantly biases against the attached divider lower edges to form a tight seal therewith while each divider is provided with lateral tabs overlying the shelf member side walls and having a specified height selected to limit the degree of pivotal displacement of that divider. Additionally, removable label holders for the divider tabs form a close mating fit therewith. Improved support means for the shelf member includes a stand cooperating with the shelf side walls or hanger brackets engageable with the shelf and walls, both serving to retain the shelf member at a fixed transverse inclination.

12 Claims, 9 Drawing Figures

FILE UNIT

This invention relates generally to office appliances and more particularly to an improved file unit of the type including a shelf or tray incorporating a plurality of pivotally attached and selectively adjustable dividers or partitions.

Filing devices according to the above general category are well known, yet many shortcomings have become evident when attempting to employ these devices heretofore available when it is desired to provide a filing unit to store, segregate and make readily available such papers frequently utilized by an employee dealing with accounts receivable, posting or stock inventory. Those experienced with attempting to store a plurality of loose papers in a filing unit provided with partitions will readily acknowledge the inherent problem of papers tending to slide beneath and between the divider members. Another problem present in many existing file units is the lack of adequate means for readily controlling both the longitudinal spacing between two adjacent dividers as well as the degree or amount of angular inclination or pivotal displacement of each individual divider.

By its very intended use such a file should be immediately adjacent the user and accordingly many units presently available are no more than a file drawer which is positioned atop a desk, thereby requiring the operator to strain his neck to look over the front of the drawer and its contents as he searches for the desired records therein or, on the other hand, require the use of a low pedestal table and then the user looks down upon the entire unit.

By the present invention a vastly improved arrangement is provided comprising a shelf or tray having a compressible or resilient layer of material co-extensive with the floor of the tray and thus underlying the entire contents of the file unit as well as all of the partitions used therewith. This compressible pad is combined with unique means for attaching each of the dividers, whereupon after attachment of a divider the compressible pad is compressed or deflected by the entire lowermost limit of the divider, thereby not only dampening any pivotal subsequent movement of the divider, but more importantly, forming a tight biasing action and seal between the bottom of the divider and the upper surface of the pad to preclude the passage of any file papers therebetween.

Ready lateral accessibility of the subject file is provided by means of either a unique stand for supporting the file tray at a 30° transverse inclination upon a table or desk top or alternatively, by hanger or bracket members adapted to support the tray at the same inclination from a relatively fixed vertical member such as a partition or panel assembly.

Accordingly, one of the primary objects of the present invention is to provide an improved file unit including a shelf having a compressible pad co-extensive with its floor and upon which one or more partitions may be disposed, each with its bottom edge being retained by the shelf in a manner ensuring deflection of the upper surface of the compressible pad to preclude the inadvertent passage of papers therebetween.

Another object of the present invention is to provide an improved file unit including a shelf containing a plurality of dividers, each provided with integral attachment/pivot means along its lower edge having free ends selectively insertable within a pair of oppositely disposed mounting means associated with the shelf side walls and wherein partition means on the shelf restrict the transverse displacement of each installed divider to retain the dividers in their use position while allowing of manual displacement of the partitions into a second position for withdrawal from the shelf.

A further object of the present invention is to provide an improved filing unit adapted to contain a plurality of pivotally attached dividers and including a pair of opposite side wall flanges disposed at specific angles to permit association with a stand serving to support the file unit at a particular transverse angle of inclination.

Still another object of the present invention is to provide an improved file unit including a shelf adapted to contain a plurality of dividers and having hanger engaging means at the ends thereof cooperating with a pair of hanger brackets to support the file unit at a specific transverse angle of inclination.

Another object of the present invention is to provide an improved file unit including a shelf containing a plurality of partitions each having lateral tabs projecting from the upper portion of the shelf side walls whereby variations of the vertical extent of these divider tabs allows various permissible angles of inclination of the dividers when the lower portions thereof are pivotally attached to the shelf side walls.

A further object of the present invention is to provide an improved file unit including a shelf containing a plurality of dividers therein, each including a pair of lateral tabs having one or more holes therethrough, for receiving a label holder constructed of resilient material and including one or more lugs snap-fitting into the divider holes.

With these and other objects in view which will more readily appear as the nature of the invention is better understood, the invention consists of the novel construction, combination and arrangement of parts hereinafter more fully described, illustrated and claimed.

Preferred and practical embodiments of the invention are shown in the accompanying drawings in which.

Similar reference characters designate corresponding parts throughout the several figures of the drawings.

Figure 1:
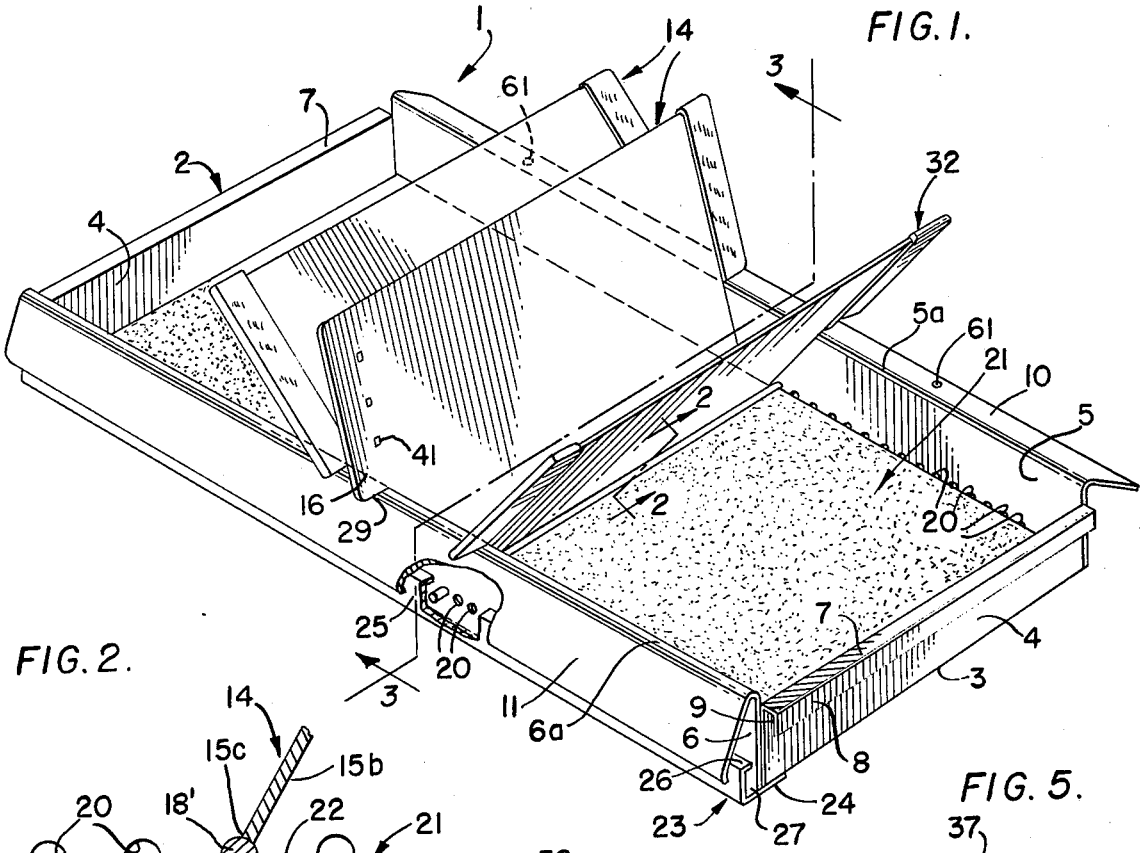
FIG. 1 is a top perspective view of a file unit according to the present invention.

Referring now to the drawings, particularly FIG. 1, the present invention will be seen to comprise a file unit generally designated 1, including a shelf or tray member 2 having a planar floor or bottom 3 of an elongated rectangular configuration and which is bounded at its opposite margins by the vertically extending end walls 4—4 and a first side wall 5 and oppositely disposed second side wall 6. The upper limits of the end walls 4—4 are defined by horizontally extending top flanges 7 projecting in an outward direction from the end walls and each will be seen to terminate in a downwardly extending outer flange 8, thereby defining an end wall cavity 9, the purpose of which will be described hereinafter.

Each of the side walls 5 and 6 extend upwardly to a point spaced above the level of the end wall top flanges 7 and are formed with a rounded upper edge 5*a* and 6*a* respectively. Extending from the rounded upper edge 5*a* is a first side wall flange 10 which, as shown most clearly in FIG. 3 of the drawings, is preferably disposed at an angle of 60° with respect to the adjacent first side wall 5, while a second side wall flange 11 will be seen to extend from the rounded upper edge 6*a* at an angle with respect to the second side wall 6 which is preferably 30°.

Figure 3:
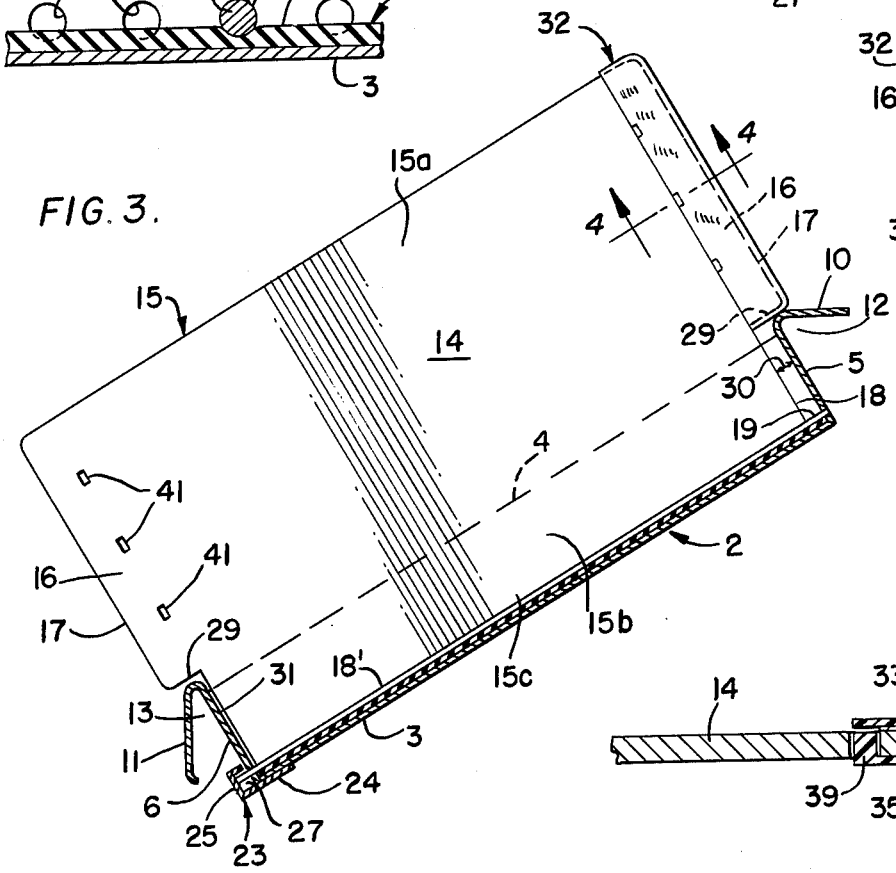
FIG. 3 is a transverse sectional view taken along the line 3—3 of FIG. 1.
Figure 4:
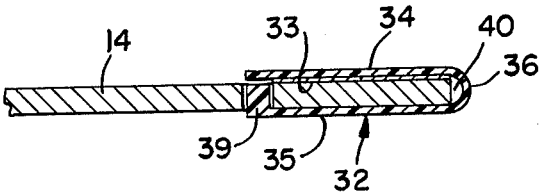
FIG. 4 is a fragmentary sectional view taken along the line 4—4 of FIG. 3.

The reasons for the afore-described inclination of the flanges 10 and 11 will be appreciated when it is understood that the file unit 1 of the present invention is intended to be utilized with the shelf 2 disposed at a transverse inclination with respect to its longitudinal extent as well as to the user, in order to provide ready lateral access to records disposed within the confines of the tray. By the formation of the 60° angle of the cavity 12 between the first side wall 5 and its flange 10 and the 30° angle of the cavity 13 between the second side wall 6 and its flange 11, it will follow that the floor 3 of the shelf 2 will be disposed at a transverse inclination of 30° with respect to the horizontal, and in this position, as illustrated in FIG. 3 of the drawings, the first side wall flange 10 will be parallel to the horizontal while the second side wall flange 11 will be normal to the horizontal and the importance of this relationship will be described hereinafter.

The shelf 2 is adapted to contain a plurality of dividers or partitions generally designated 14, each of which comprises a divider body 15 constructed of any suitable substantially rigid planar material such as plastic or metal. Each divider body 15 includes a pair of lateral tabs 16 projecting from the upper section 15*a* of the body and terminating in side edges 17, which will be seen to extend well beyond the lateral limits of the two shelf side walls 5 and 6. The divider body lower section 15*b* is provided with opposite lateral edges 18—18 spaced well inwardly from the two juxtaposed side walls 5 and 6 of the file shelf 2, while the bottom or lower edge 15*c* of the divider body lower section 15*b* will be seen to be provided with pivot means in the form of an attachment/pivot member 18′ having free ends or projections 19 disposed beyond the divider lateral edges 18, yet terminating short of the lateral extent of the dividers as defined by the tab edges 17 for reasons which will be appreciated later on. The attachment/pivot member 18′ is preferably of rod or tubular construction and it will be understood that the entire divider construction as described to this point may be of unitary or integral fabrication, possessing limited flexibility, which feature readily lends itself to formation of the dividers 14 from a synthetic resinous composition such as rigid vinyl.

The attachment member 18′ provides ready means for the quick attachment of the dividers within the shelf 2 by means of mounting means associated with the shelf side walls adjacent the bottom 3. A plurality of mounting holes 20 formed in each of the side walls 5 and 6 provides handy means serving to accomplish this attachment. An important feature of the present invention is the provision of a resilient or compressible pad 21 within the shelf 2 and which is preferably co-extensive with the entire upper surface of the tray floor 3 as shown most clearly in FIG. 1 of the drawings. The pad 21 may be constructed of any suitable compressible material such as natural or synthetic rubber, and is installed within the shelf 2 such that its top surface 22 is in a normal at-rest position in a plane disposed above at least the lower limits of all of the divider mounting holes 20 formed in each of the tray side walls 5 and 6. The exact amount of the mounting holes 20 which will be normally masked by the body of the resilient pad 21 will, of course, depend upon the degree of compressibility of the material employed in forming the pad, however, the important feature to note is that at least a portion of the lower extent of each of the mounting holes 20 will normally be covered by the material of the pad 21 adjacent each hole 20 not being used to mount a divider 14.

With the foregoing structure in mind, the assembly and removal of each divider 14 within the shelf 2 may now be described, with particular reference being made to FIG. 3 of the drawings. Initially, one free end 19 of the attachment/pivot member 18′ is inserted into the selected one of the mounting holes 20 in the first side wall 5 and it will be understood that in view of the aforementioned pad 21 it will be necessary to apply a slight downward pressure against the top surface 22 of this pad to achieve such insertion. Thereafter, the entire divider 14 is moved toward the first side wall 5 until the juxtaposed lateral edge 18 of the divider body lower section 15*b* abuts the inner surface of the first side wall 5. This displacement of the divider has positioned the opposite attachment/pivot member free end 19 well inwardly of the second side wall 6 so that this latter projection 19 may be aligned with a mounting hole 20 in the second side wall 6 aligned with the selected hole 20 in the first side wall 5, after which the operator, by applying a slight downwardly directed exertion upon the divider to slightly compress the pad 21, may proceed to transversely displace the divider 14 to urge the latter projection 19 through the selected second hole 20.

Figure 2:
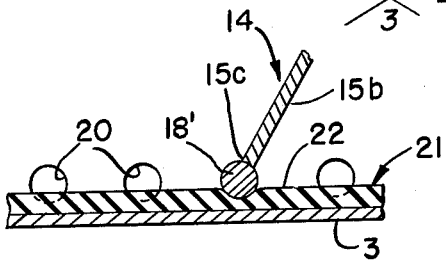
FIG. 2 is a fragmentary cross-sectional view taken along the line 2—2 of FIG. 1.

Positive means are provided to ensure proper lateral or transverse orientation of the installed dividers and also to preclude unwanted release of the first free end 19 of the attachment/pivot member 18′ from the hole 20 in the first side wall 5. This structure comprises a partition or divider stop 23 fixedly attached to the bottom of the shelf 2 adjacent the second side wall 6 as shown most clearly in FIGS. 1 and 3 of the drawings. The partition 23 is provided with a base 24 secured to the floor 3 of the tray 2 and includes a vertically extending stop wall 25 terminating in an inwardly directed top flange 26, between which elements is formed the space 27 within which it will be seen the second free ends 19 of the attachment/pivot member 18′ are disposed when the dividers 14 are in the use position. The dividers are retained in this use position by a combination of both gravity when the file unit 1 is supported in the inclined position illustrated in FIG. 3, and more positively, in view of the frictional engagement afforded by the compressed material of the resilient pad 21 engaging the complete extent of the lower portion of the divider 15*b* as shown in FIG. 3 and more in detail in FIG. 2 of the drawings. With this arrangement and by the formation of the pad 21 of a rubber-like material, the coefficient of friction between the lower portion of the attachment-/pivot member 18' and the top surface 22 of the pad will be obviously quite high and several advantages accrue as a result of this construction. Not only is the retention of the partition 14 in the use position assured, but more importantly, a complete and tight sealing engagement will at all times be present between the bottom portion of each divider and the top surface 22 of the pad 21 carried in the bottom of the shelf 2 such that it is extremely unlikely that during the use of the file unit 1, any papers can slide beneath and between the dividers. Additionally, it will be apparent that a snubbing or dampening action is afforded by the referenced frictional engagement between the dividers and the pad 21 thereby preventing any rattle or accidental unwanted pivotal displacement of the dividers between a left-hand and right-hand position.

The removal of any one of the dividers 14 from the use position as shown in FIG. 3 of the drawings merely involves a reversal of the steps employed to achieve its installation. When considering the manipulation of the divider 14, the dimensions of the notch 28 as formed by the width of the tab lower edge 29, position of the divider body lateral edge 18 and the length of the attachment/pivot member projections 19, will be understood to be critical. In the illustrated use position the distal portion of the projection 19 associated with the first side wall 5 will be seen to be flush with the outer surface of this side wall when the opposite projection 19 is abutting the stop wall 25 of the partition stop 23, and when in this position it will be noted that the space between the inner surface of the first side wall 5 and the adjacent divider lateral edge 18, as represented by the double ended arrow 30, will be understood to be greater than that length of the opposite projection 19 extending from the inner surface 31 of the second side wall 6 to the stop wall 25. Thus, it will follow that when the operator laterally displaces the divider 14 toward the first side wall 5, by the time the distance 30 has been traversed, the distal portion of the other projection 19 will have been completely withdrawn from the partition stop space 27 and the juxtaposed mounting hole 20 in the second side wall 6 such that the divider may be pivoted upwardly or longitudinally of the shelf 2 until sufficient clearance is provided to completely withdraw the remaining or first projection 19 from its hole in the first side wall 5.

Figure 5:
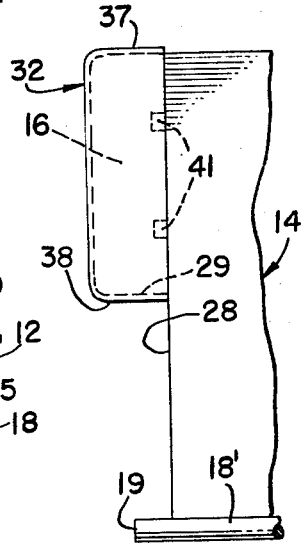
FIG. 5 is a partial end view of an alternative divider provided with a lateral tab of a lesser vertical height than that shown on the divider illustrated in FIG. 3.

As previously mentioned, the vertical height or extent of the lateral tabs 16—16 as defined by the position of their lower edges 29 is quite critical insofar as the pivotal action of the divider is concerned. Quite obviously, as the position of the tab lower edge 29 is raised such as from that position shown in FIG. 3 to the alternative position such as shown in the divider of FIG. 5, the vertical extent of the notch 28 therebeneath is correspondingly increased and it is this variable relationship which permits the selection of various degrees of permissible pivotal movement of the installed partitions or dividers 14. As shown in FIG. 1 of the drawings, the dividers are each retained in their angular or pivotal position, by the abutment of the lower edge 29 of the tabs 16 upon the rounded upper edges **5*a* and 6*a* of the shelf side walls 5 and 6, and thus each divider may be pivoted about its attachment/pivot member 18' to an equal degree of inclination to either the right or left of its pivot member 18', and the exact amount of this inclination will be regulated by the vertical disposition of the tab lower edges 29. It will be quite obvious that the smaller the tab 16, in other words, the higher the position of its lower edge 29, the greater the range of pivotal displacement of the divider and accordingly, it will be understood that dividers having various sizes of tabs 16 may be employed with the present file unit according to the demands of the user and it will be appreciated that with any one file unit 1, all of the dividers may have lateral tabs 16 of the same size or dividers may be combined in any one file unit having tabs 16** of different sizes.

Either one or both of the tabs 16 of the dividers 14 provide obvious locations for the provision of suitable labels or other indicia to identify the contents of papers or files to be disposed adjacent any one of the dividers and accordingly separate means in the form of the label holders, generally designated 32, are provided to facilitate the retention of labels 33 in an overlying manner upon any one of the selected tabs 16. The holders 32 are preferably of unitary construction and formed of a suitable transparent material having at least a limited degree of flexibility, such as synthetic plastic, and each will be seen to comprise a glove-like member adapted to mate with and be slid over the exposed outer edges of the tab 16. The holder 32 includes a plain wall 34 joined to a locking wall 35 by means of a side portion 36 and two end portions 37-38. Adjacent the free end of the locking wall 35 are a plurality of lugs 39 projecting into the pocket 40 formed by the label holder and toward the plain wall 34 thereof. The lugs 39 are of a configuration and of a number adapted to mate with a similar number of mounting holes 41 formed in the body 15 of the divider upper section **15*a*. Any number of lugs 39 and corresponding number of mounting holes 41 may be provided according to the dimension of the divider tab 16 being considered, with a minimum of two such lugs and holes being desirable to ensure a positive snap-fitting and retention of a label holder 32** such as shown in FIG. 5.

Figure 6:
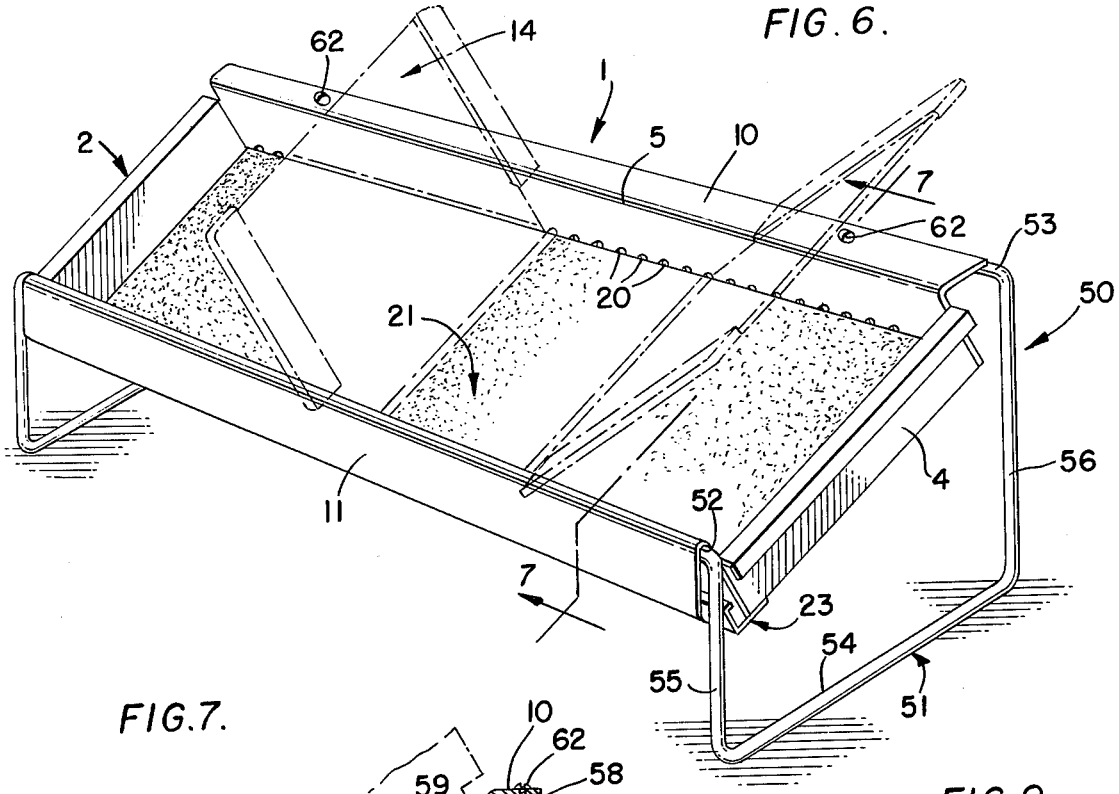
FIG. 6 is a top perspective view and illustrates the file unit of FIG. 1 as supported in a transversely inclined position by means of a stand.
Figure 7:
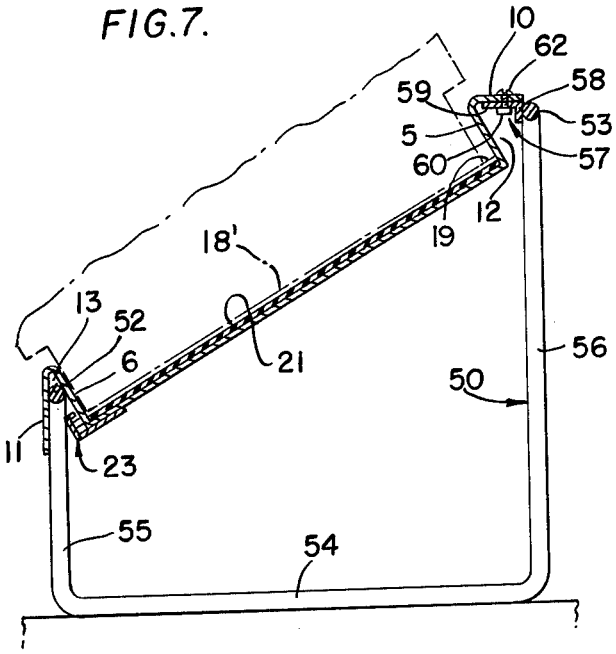
FIG. 7 is a transverse sectional view taken along the line 7—7 of FIG. 6.

As previously mentioned, the instant file unit 1 is most conveniently utilized when disposed at a transversely inclined position as illustrated in FIG. 3 of the drawing, and accordingly various means are provided to support the shelf 2 in this position, either upon a fixed planar surface such as a table or desk top or alternatively upon a fixed vertical supporting member such as a partition or panel. The former arrangement is most conveniently provided by means of the stand generally designated 50 and which is illustrated in FIGS. 6 and 7 of the drawings. This stand is preferably constructed of rod or tubular stock so as to provide an endless or unitary construction including a pair of U-shaped end portions 51 disposed adjacent the two end walls 4—4 of the shelf 2 and joined to one another by means of a front horizontal support member 52 and a rear horizontal support member 53. Each U-shaped end portion 51 further includes a horizontal base member 54 joined at its ends respectively to a short front vertical leg 55 and a longer rear vertical leg 56 and which, combined with the two support members 52 and 53 form a rigid cradle within which the file unit 1 is suspended. The relative height of the front and rear legs 55 and 56 are selected so that a transverse line bisecting the support members 52 and 53 will be understood to form an angle of 30° with the horizontal base members 54 and thus with the supporting surface therefor so that when the front horizontal support member 52 is disposed within the cavity 13 along one side of the shelf 2 and the side wall flange 10 of the first side wall 5 is disposed atop the rear horizontal support member 53, the side wall flange 10 will be horizontally disposed and the floor 3 of the shelf 2 will be inclined 30° with respect to the base members 54 of the stand 50.

Anchoring means are provided to ensure a rigid interconnection between the file unit 1 and the stand 50 and comprises at least a pair of mounting brackets 57 suitably affixed such as by welding to the rear horizontal support member 53. Each mounting bracket may include a side flange 58 attached to the support member 53 and a horizontally disposed top flange 59, which top flange includes an aperture therethrough and female fastener means such as a weld nut 60 secured to the undersurface thereof. The first side wall flange 10 includes a fastener receiving opening 61 formed adjacent each of the openings in the mounting brackets 57 and through which a suitable male fastener 62 is inserted and retained by the nut 60 to lock the file unit 1 to the stand 50 as shown in FIGS. 6 and 7 of the drawings.

Figure 9:
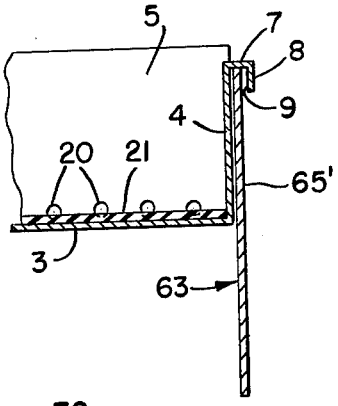
FIG. 9 is a fragmentary longitudinal sectional view taken along the line 9—9 of FIG. 8.
Figure 8:
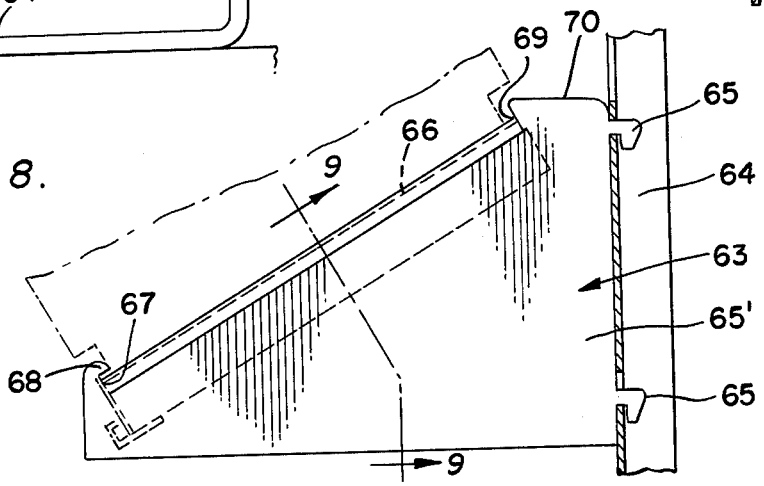
FIG. 8 is an end elevation illustrating a hanger bracket as used to support the file unit shelf in a transversely inclined position upon a fixed supporting member.

In the case where the file unit is to be supported in its inclined use position immediately adjacent a panel or wall, then hanger brackets 63 shown in FIGS. 8 and 9 of the drawings, are employed. Such a hanger bracket 63 is adapted to be rigidly attached to any vertical structure such as the supporting member 64 by well known means such as the hooks 65 and preferably is constructed of a rigid planar plate 65' having an inclined recessed seat 66 formed in its upper surface at an angle of 30° to the horizontal and bounded at its lower end by the bottom shoulder 67 having the overhanging and upwardly directed tab 68. The upper limit of the seat 66 is defined by the top shoulder 69 which in turn communicates with the horizontally disposed top edge 70. The length of the recessed seat 66 corresponds with the length of the shelf top flanges 7, while the top shoulder 69 is disposed at an angle of 60° with respect to its adjacent top edge 70.

With the foregoing structure in mind it will be seen that it is a simple matter to install the shelf 2 of the present invention upon a pair of hanger brackets 63 which are spaced apart a distance equal to the distance between the two end wall cavities 9 of the particular file unit being considered. The installation is initially achieved by tilting the file unit 1 at an angle greater than 30° with respect to the horizontal so that the edge of the two end wall top flanges 7—7 which are adjacent the second side wall 6 may be inserted beneath the tabs 68 of the two brackets 63, after which the other or first side wall 5 of the shelf 2 may be lowered to fully place the two end wall top flanges 7 upon the two seats 66 and into the position as shown in FIG. 8 of the drawings, at which point the edges of the first side wall 5 and its flange 10 will be masked by the top edge 70 and top shoulder 69 of the brackets. With the foregoing arrangement in mind, it will follow that the filing unit 1 will be securely attached by means of the hanger bracket 63 and should a user accidentally strike the lower portion of the second side wall 6 in an upward direction there would be no danger of the shelf 2 becoming dislodged from the brackets in view of the disposition of the tab 68 disposed in an overlying manner above the shelf end wall top flanges 7.

I claim:

1. A file unit including, a shelf member having a floor and first and second side walls, and side walls each provided with a plurality of distinct opposed divider mounting means adjacent said floor, a divider including lateral edges and a lower edge extending therebetween, pivot means extending along the entire length of said lower edge and having lateral projections disposed beyond said divider lateral edges and engageable within a selected pair of said opposed mounting means to pivotally attach said divider to said shelf member, each said mounting means having a vertical and lateral extent providing pivotal displacement of said inserted projection, a locally compressible resilient pad overlying said floor and substantially co-extensive therewith, said pad having a top planar surface normally disposed in a vertical plane at least partially obstructing said vertical extent of all said mounting means and thus blocking insertion of said divider projections into said mounting means whereby, said pad top surface is locally compressed by and only beneath said pivot means and its projections when said divider is attached to said shelf member and thereafter constantly engages and biases said pivot means to form a pressure seal therewith extending beneath the entire extent of said divider.

2. A file unit according to claim 1 wherein, said mounting means includes a plurality of holes in said side walls.

3. A file unit according to claim 1 wherein, said pivot means and lateral projections comprise a rod-like member integral with said divider.

4. A file unit according to claim 1 wherein, said side walls include an upper edge, said divider having a lower section provided with said lateral edges normally spaced inwardly from said side walls and extending upwardly from said pivot means to a plane no lower than the height of said side wall upper edges when said divider is vertically disposed, an upper section on said divider including lateral tabs provided with side edges disposed beyond said side wall upper edges, and a lower edge on said tabs engageable with said side wall upper edges to limit the pivotal displacement of said divider about said pivot means.

5: A file unit according to claim 4 including, a plurality of said dividers having said tab lower edges disposed at various heights relative their respective pivot means whereby, said dividers may be pivotally displaced various degrees until limited by abutment of said tab lower edges with said side wall upper edges.

6. A file unit according to claim 4 including, a label holder removably attachable to one said divider tab, said holder provided with a pair of spaced walls adapted to overly said tab, a lug projecting from one said holder wall and said divider having a hole adapted to receive said lug to retain said holder upon said tab.

7. A file unit according to claim 1 wherein, said mounting means includes a plurality of holes in said side walls, said pivot lateral projections comprise rod-like members slidable within said holes, said divider having a lower section provided with said lateral edges normally spaced inwardly from said side walls and the length of said pivot means between the ends of said lateral projections being greater than the distance between said two side walls whereby, said divider must be transversely shifted to successively insert and remove said lateral projections relative said holes.

8. A file unit according to claim 7 including, a stop wall spaced from the outside of one said shelf side wall juxtaposed said mounting holes therethrough to limit the axial displacement of said pivot means and the length of said pivot means between the ends of said lateral projections being no less than the distance between said stop wall and said shelf side wall on the opposite side of said shelf.

9. A file unit according to claim 1 including, means interlocked with said shelf member to support said shelf member in a relatively fixed position.

10. A file unit according to claim 9 wherein, said support means retains said shelf member in a transversely inclined position.

11. A file unit according to claim 9 including, a first and second flange extending respectively outwardly from the top of said two side walls, said support means including a stand having rear and front support members engaging respectively said first and second flanges.

12. A file unit according to claim 9 including, end walls on said shelf member each having an outwardly directed top flange terminating in a downwardly extending flange to define a downwardly facing cavity therebetween, said support means including a stationary bracket adjacent each shelf end wall, and each said bracket provided with a recessed seat of a length substantially equal to the length of said shelf end wall flanges to receive said top flange therein.

* * * * *